US006821054B2

(12) United States Patent
Ballard

(10) Patent No.: US 6,821,054 B2
(45) Date of Patent: Nov. 23, 2004

(54) METHOD AND SYSTEM FOR LAYING PIPE THROUGH THE USE OF A PLOW

(75) Inventor: Michael L. Ballard, Houston, TX (US)

(73) Assignee: Horizon Vessels, Inc., Houston, TX (US)

( * ) Notice: Subject to any disclaimer, the term of this patent is extended or adjusted under 35 U.S.C. 154(b) by 0 days.

(21) Appl. No.: 10/224,014

(22) Filed: Aug. 19, 2002

(65) Prior Publication Data

US 2004/0031174 A1 Feb. 19, 2004

(51) Int. Cl.[7] ..... F16L 1/12

(52) U.S. Cl. ..... 405/159; 405/163; 405/174; 37/307

(58) Field of Search ..... 405/159–164, 405/174, 180, 183; 37/307, 342–344, 366, 367

(56) References Cited

U.S. PATENT DOCUMENTS

| | | | | | |
|---|---|---|---|---|---|
| 3,898,852 | A | * | 8/1975 | Ezoe et al. | 405/164 |
| 4,280,289 | A | | 7/1981 | Bassompierre-Sewrin | 37/309 |
| 4,479,741 | A | | 10/1984 | Berti et al. | 405/163 |
| 4,586,850 | A | | 5/1986 | Norman et al. | 405/163 |
| 4,588,329 | A | * | 5/1986 | Gilchrist, Jr. | 405/283 |
| 4,695,204 | A | * | 9/1987 | Bell | 405/283 |
| 4,714,378 | A | | 12/1987 | Lincoln | 405/163 |
| 4,808,037 | A | | 2/1989 | Wade et al. | 405/226 |
| 4,992,000 | A | | 2/1991 | Doleshal | 405/163 |
| 5,193,938 | A | * | 3/1993 | Akesaka | 405/157 |
| 5,288,172 | A | | 2/1994 | Reuhl | 405/163 |
| 5,462,389 | A | * | 10/1995 | Messina | 405/183 |
| 6,036,403 | A | * | 3/2000 | Hitzke | 405/164 |
| 6,050,009 | A | | 4/2000 | Adamson et al. | 37/367 |
| 6,061,932 | A | | 5/2000 | Rowley | 37/309 |
| 6,116,818 | A | | 9/2000 | Bitetto et al. | 405/159 |
| 6,273,642 | B1 | | 8/2001 | Anderson | 405/163 |

* cited by examiner

*Primary Examiner*—Robert E. Pezzuto
*Assistant Examiner*—Tara L. Mayo
(74) *Attorney, Agent, or Firm*—Jones, Walker, Waechter, Poitevent, Carrere & Denegre, LLP

(57) ABSTRACT

A method and system for laying and burying pipe a seabed using a pipe trenching plow that is advanced along the seabed to form a continuous trench. The pipe trenching plow cuts a pilot hole in the seabed using a cutting apparatus and widens and forms a trench from the pilot hole using expandable spreading side sections. A pipe guiding sled also is used to support and guide the pipe into the trench and a trench box section retains the trench geometry as the pipe trenching plow is continuously advanced in a forward direction. The pipe trenching plow cutting the trench and burying the pipe with minimal turbidity and seabed disturbance.

23 Claims, 6 Drawing Sheets

METHOD AND SYSTEM FOR LAYING PIPE THROUGH THE USE OF A PLOW

BACKGROUND OF THE INVENTION

1. Field of the Invention

The present invention relates to a method and system for laying and burying pipe in a seabed using a plow apparatus that is advanced along the seabed to form a continuous trench. The plow apparatus of the present invention performs the burying of the pipe with minimal turbidity and other seabed disturbance making it attractive for environmentally sensitive applications. More particularly, the plow apparatus of the present invention includes a pipe guiding sled and a pipe trenching plow. The pipe guiding sled cradles and supports the pipe and guides the pipe downward for laying in the seabed. The pipe trenching plow cuts the seabed and using expandable spreading side sections widens and forms a trench. A trench box section retains the trench geometry and lays the pipe into the trench as the plow apparatus is continuously advanced in a forward direction.

2. Description of the Related Art

There are commonly known a wide variety of prior art systems for laying and burying pipes in seabeds. As discussed in this description, the term "seabed" refers to any water bottom where pipe may be laid including, for example, ocean bottoms, lake bottoms, river bottoms or canal bottoms. The types of pipe generally laid and buried by these systems are of varying diameters and materials and may include, for example, oil and gas transportation pipes, communications cabling, sewerage and water pipes and other utility transportation pipes.

Generally, these systems use either a plow or a jetting machine or some combination of both to cut the seabed trench for laying the pipe. These systems are generally towed along the pipeline path either by a surface vessel or by an underwater tractor machine and may be used to bury an existing pipeline or to lay a new pipeline.

Pipe laying systems that use a conventional plow to cut the seabed usually cut a V-shaped trench. In cutting such a trench, such plows stir up the seabed significantly and create a trench that is wider at the seabed then necessary. Such plow systems also are not as effective in seabeds with inconsistent soil textures cutting trenches of varying depth and width.

Pipe laying systems that use jetting machines typically are not effective in hard bottom applications and in soft bottom applications usually cause a very high level of turbidity and seabed disturbance. The trench formed by such pipe laying systems using jetting machines is also often wider than necessary and of an irregular geometry.

Thus, it is desirable for a pipe laying system to be effective to cut a trench of a geometry that closely fits the size of the pipeline to avoid unnecessary seabed disturbance. It is also desirable to avoid excessive turbidity in the cutting of the trench.

SUMMARY OF THE INVENTION

The pipe laying method and system of the present invention was designed for use in many subsea pipeline laying applications and is particularly intended for use in applications requiring minimal turbidity and seabed disturbance. The pipe laying method and system of the present invention causes minimal environmental damage to a seabed environment by reducing the disturbance to chemicals and other contaminants that may be settled in the seabed. Furthermore, in laying pipelines in environments near coral reefs or other biologically sensitive areas, the pipe laying method and system of the present invention minimizes the impacts of turbidity on such marine habitats.

The pipe laying system of the present invention includes a towable pipe guiding sled and a towable pipe trenching plow. The pipe guiding sled and the pipe trenching plow may be separate apparatus or they may be coupled together, the pipe guiding sled positioned forward of the pipe trenching plow. Both the pipe guiding sled and the pipe trenching plow engage the pipeline and may be towed along the pipeline path by a surface vessel or an underwater tractor. The pipeline may be an existing pipeline or may be a new pipeline that is in the process of being laid. The pipe guiding sled and the pipe trenching plow are equipped with bridles for harnessing by cable or chain to the surface vessel or underwater tractor machine for towing purposes. Alternatively, an underwater tractor machine may be mechanically coupled to either the pipe guiding sled or the pipe trenching plow for advancing along the seabed.

The pipe guiding sled includes a base and a pair of laterally spaced pontoons for engaging the seabed surface as the pipe guiding sled is advanced. The pipe guiding sled further includes a plurality of pipe guide assemblies mounted to the upper surface of the base for cradling the pipe and for guiding each pipe section at a consistent downward angle toward the trench. The degree of the angle of descent of the pipe will depend on the diameter and material properties of the pipe.

The pipe trenching plow follows the pipe guiding sled along the desired path of the pipeline and performs the actual cutting of the trench for laying the pipe. At the forward end of the pipe trenching plow is positioned a cutting apparatus that cuts a small pilot hole or groove in the seabed for advancing the pipe trenching plow. In one embodiment, such a cutting apparatus is a pair of vertically mounted counter-rotating cutters. Alternatively, such cutting apparatus could be a series of jet nozzles positioned along a tube member or plurality of tube members. Such cutting apparatus could also be a narrow blade or plowshare. Unlike prior art systems, the cutting apparatus is only used to cut the pilot hole in the seabed and not the entire pipe trench causing a significant reduction in turbidity. The choice of the cutting apparatus will typically depend on the characteristics of the seabed.

The pipe trenching plow further includes a pair of spreading side sections extending rearward from the cutting apparatus, the spreading side sections forming a plowing wedge. As the spreading side sections enter the pilot hole, the spreading side sections plow back the seabed to form a pipe trench. To further achieve the widening and formation of the trench, the spreading side sections are repeatedly expanded by a pair of hydraulically operated piston rod assemblies to form a rectangular pipeline trench. As the plow advances, the spreading side sections are continuously expanded and contracted to create a shoveling and packing motion on the seabed to widen and form the rectangular trench. Through this continuous motion of the spreading side sections, the pipe trench is cut and sized to the geometry required by the diameter of the pipe being laid. As compared to other prior art systems, the repetitive expanding and contracting motion of the spreading side sections as the plow system is advanced along the pipeline path effectively forms a pipe trench with reduced turbidity and disturbance to the seabed.

Following the spreading side sections of the pipe trenching plow is a trench box section, or as in the preferred embodiment, a plurality of trench box sections. In using a plurality of trench box sections, the leading trench box section is coupled to the spreading side sections and each subsequent trench box section is coupled to the preceding trench box section. Each trench box section has two side plates and a bottom plate, each side plate is braced by an outwardly extending pontoon. The trench box sections further pack and form the pipe trench and guide the pipe into the trench using pipe support rollers that cradle the pipe at the pipe's angle of descent.

Finally, the pipe trenching plow includes a trench covering section that follows the trailing trench box section. The trench covering section includes a chute apparatus that allows the system user to cover the pipe by pouring a covering material, such as shells or sand, over the pipe after it is laid and rests in the pipe trench.

These and other features and advantages of the present invention will become apparent from the following detailed description, the accompanying drawings and the appended claims.

BRIEF DESCRIPTION OF THE DRAWINGS

For a further understanding of the features and advantages of the present invention, reference should be made to the following detailed description taken in conjunction with the accompanying drawings in which like parts are given like reference numerals and wherein.

DETAILED DESCRIPTION

Figure 1:
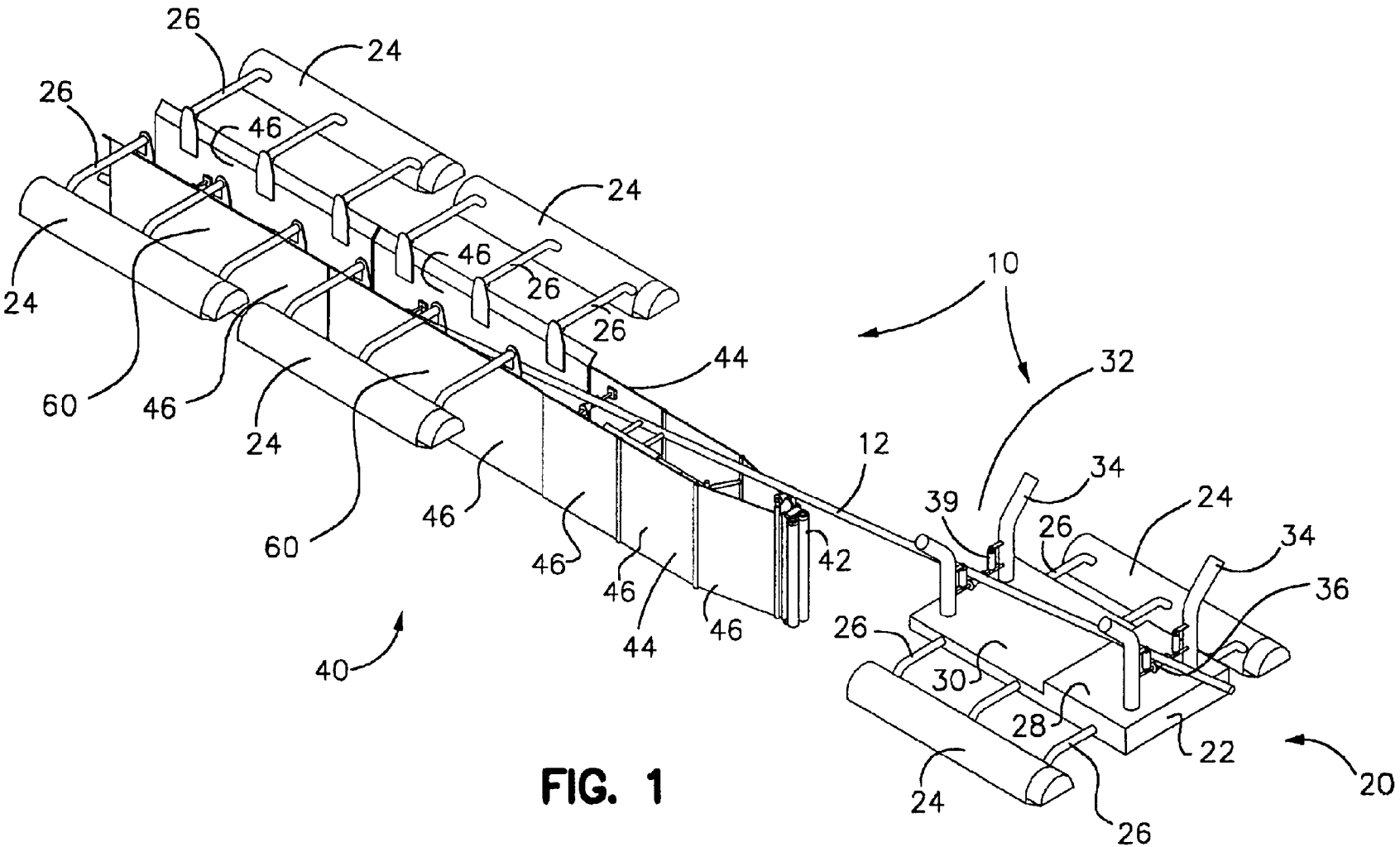
FIG. 1 is a perspective view of the pipe laying system of the present invention.

Referring now to the drawings, reference numeral 10 is used to generally designate the pipe laying system of the present invention. As shown in FIGS. 1–5, pipe laying system 10 includes a pipe guiding sled 20 and a pipe trenching plow 40. The pipe guiding sled 20 and the pipe trenching plow 40 may be separate apparatus as shown or they may be coupled together. The pipe guiding sled 20 is positioned forward of the pipe trenching plow 40, and, if coupled together, the pipe guiding sled 20 is attached to the upper leading edge of the pipe trenching plow 40.

The pipe guiding sled 20 and the pipe trenching plow 40 each engage the pipe 12 and are designed to be advanced along the intended pipeline path. Each of the pipe guiding sled 20 and the pipe trenching plow 40 may be equipped with bridle apparatus (not shown) for harnessing by cable or chain to a surface vessel or underwater tractor machine for towing purposes. Alternatively, an underwater tractor machine may be mechanically coupled to either the pipe guiding sled 20 or the pipe trenching plow 40 to advance them along the seabed.

In one embodiment, the pipe guiding sled 20 includes a base 22 and a pair of laterally spaced pontoons 24 rigidly connected to the base 22 by a plurality of outwardly extending cross members 26. The bottom surface of the pontoons 24 are dragged along the floor of the seabed as the pipe laying system 10 advances providing stability and bracing to the pipe guiding sled 20. The base 22 includes an upper surface having a forward elevated step portion 28 and a rearward flat portion 30. Mounted to the upper surface of the base 22 are a plurality of pipe guide assemblies 32. In one embodiment, one pipe guide assembly 32 is mounted on the forward elevated step portion 28 of the base and a second pipe guide assembly 32 is mounted on the rearward flat portion 30 of the base. It can be appreciated, however, that additional pipe guide assemblies 32 could be mounted to the base 22 at various locations.

Figure 2:
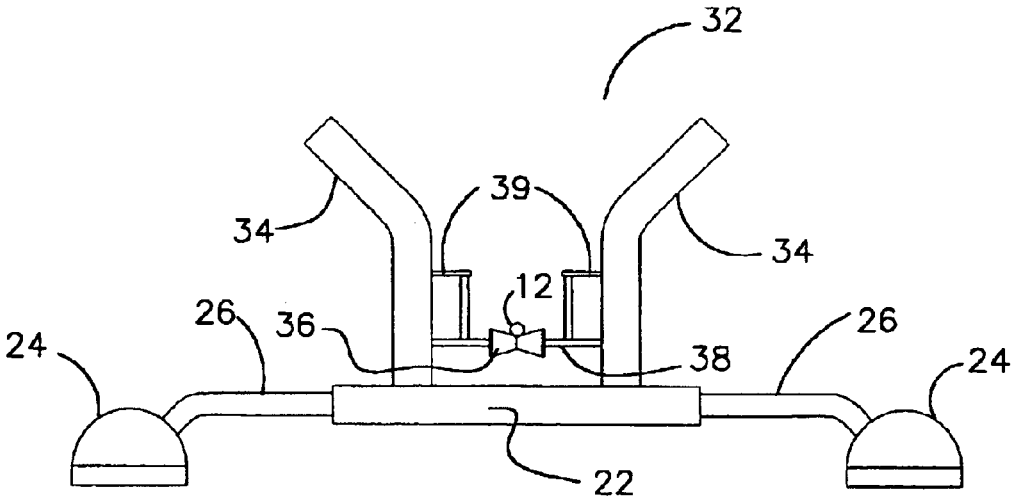
FIG. 2 is a front view of the pipe guiding sled of the pipe laying system of the present invention.
Figure 3:
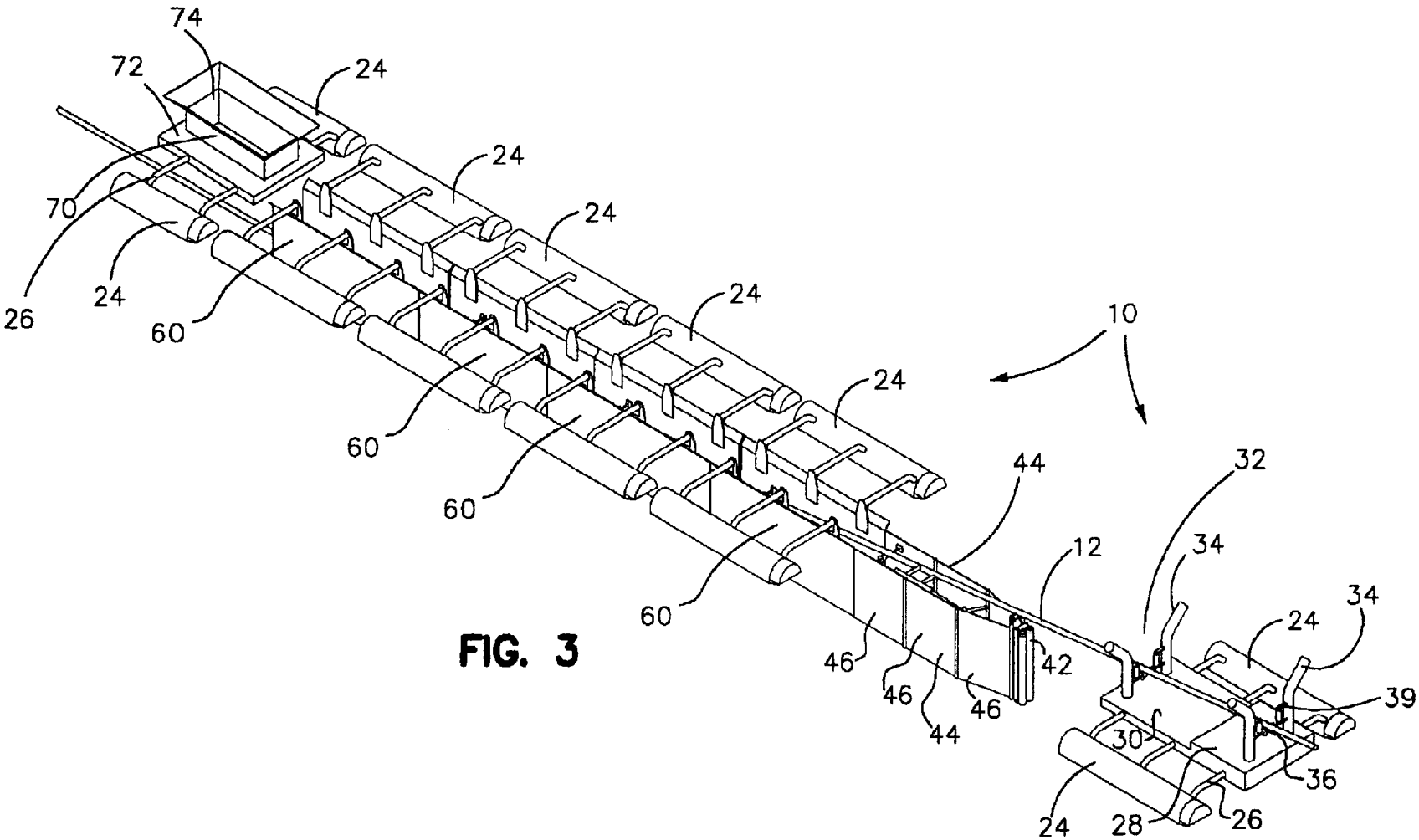
FIG. 3 is a second perspective view of the pipe laying system of the present invention showing a plurality of trench box sections and a trench covering section.

As best shown in FIG. 2, each pipe guide assembly 32 is designed to cradle and support the pipe 12 as the pipe 12 descends toward the trench. The pipe guide assemblies 32 guide each pipe section at a consistent downward angle of approach to the trench. The degree of the angle of the descent of the pipe 12 will depend on the diameter and material properties of the pipe 12.

Each pipe guide assembly 32 includes a pair of upwardly extending, laterally spaced guide members 34. Near the top of each guide member 34, the guide member 34 is bent further outward such that the pipe guide assembly 32 forms a "Y" shape. Intermediate each pair of guide members 34 is positioned a pipe support roller 36 rotatably mounted to a roller bar 38 joined between the pair of guide members 34. Each roller bar 38 is further supported by a plurality of support braces 39 attached to the guide members 34.

Referring again generally to FIGS. 1–5, each pipe support roller 36 rotatably engages and supports the pipe 12 being guided toward the trench. The pipe support roller 36 included in the forward pipe guide assembly 32 is positioned at a higher elevation than the pipe support roller 36 included in the rearward pipe guide assembly 32 causing the pipe as it is cradled by each pipe support roller 36 to slope at a consistent downward angle toward the trench. Because the degree of the angle of descent of the pipe 12 is a function of the diameter and material properties of the pipe, the elevation of the pipe support rollers 36 may be adjusted in order to lay various types of pipe. During placement of the pipe guiding sled 20 under the pipe, the "Y" shape of the pipe guide assembles 32 assist the user to guide the pipe more easily at the angle formed by the pipe guide assemblies 32.

The pipe laying system 10 of the present invention further includes a pipe trenching plow indicated generally in the drawings with the reference numeral 40. The pipe trenching plow 40 is the apparatus that performs the cutting and forming of the pipe trench geometry.

Figure 8:
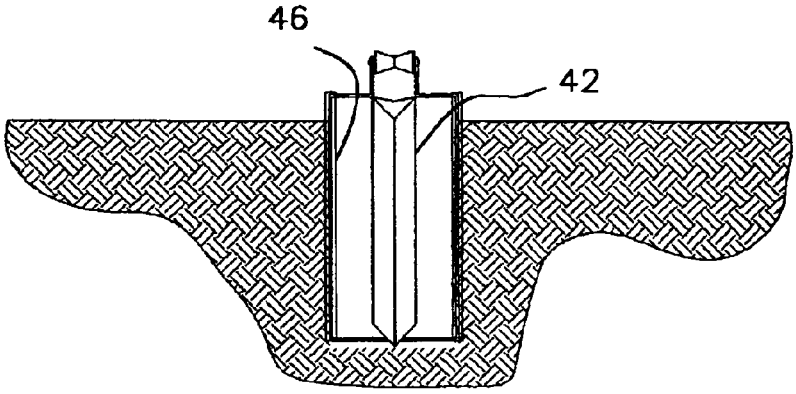
FIG. 8 is a front view of the pipe trenching plow of the pipe laying system of the present invention wherein the cutting apparatus is a cutting blade.
Figure 9:
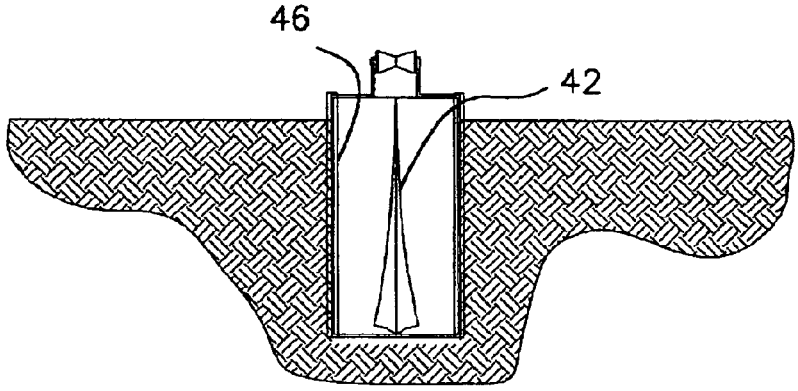
FIG. 9 is a front view of the pipe trenching plow of the pipe laying system of the present invention wherein the cutting apparatus is a plowshare.
Figure 6:
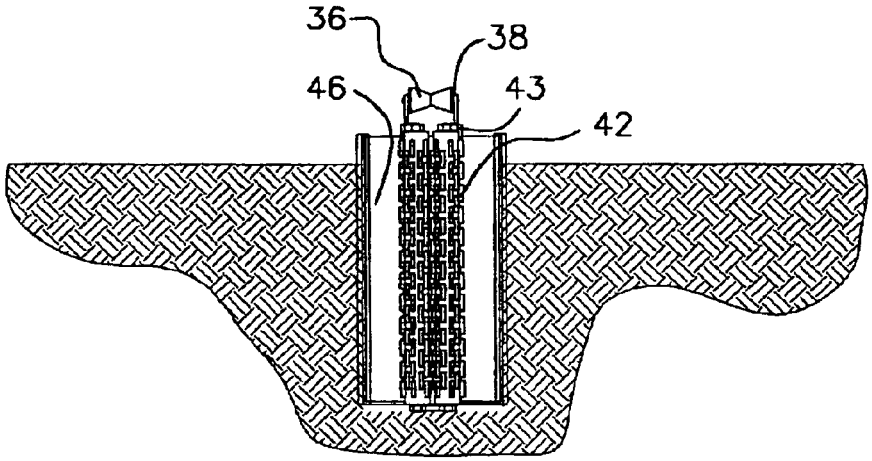
FIG. 6 is a front view of the pipe trenching plow of the pipe laying system of the present invention wherein the cutting apparatus is a pair of vertically mounted counter-rotating cutters.
Figure 7:
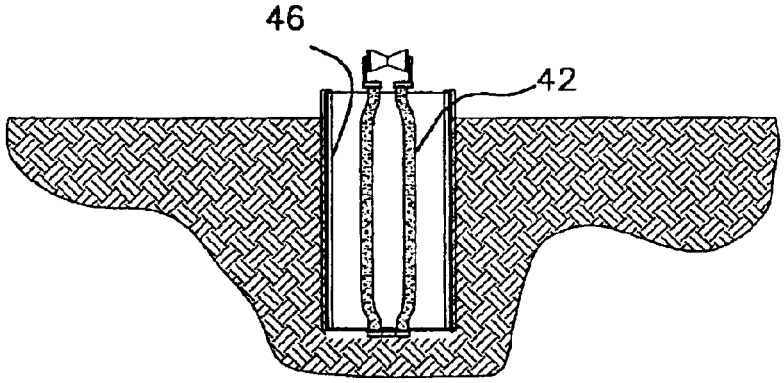
FIG. 7 is a front view of the pipe trenching plow of the pipe laying system of the present invention wherein the cutting apparatus is a plurality of jetting nozzles positioned along a pair of vertically mounted tube members.
Figure 10:
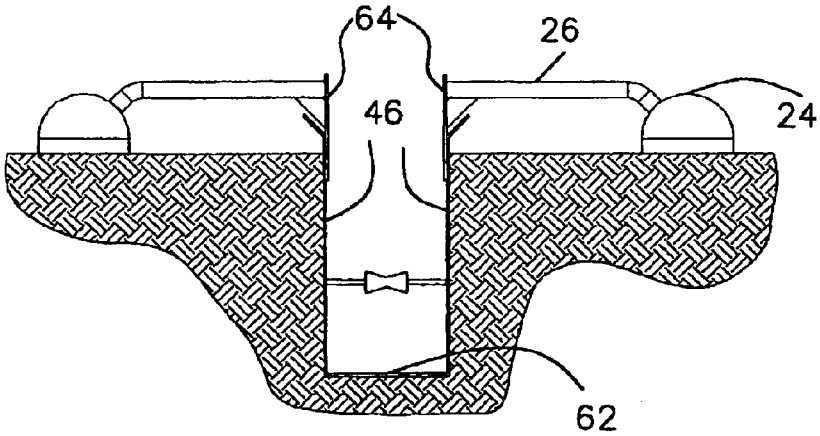
FIG. 10 is a rear view of a trench box section of the pipe laying system of the present invention.

As shown in FIGS. 6–9, at the leading edge of the pipe trenching plow 40 is positioned a cutting apparatus 42 designed to cut a pilot hole in the seabed for further advancement of the pipe trenching plow 40. A pilot hole is a "starter" hole or groove in the seabed from which the pipe trench will be formed. In one embodiment, the cutting apparatus 42 comprises a pair of vertically mounted counter-rotating cutters as shown in FIG. 6. As appreciated by one skilled in the art, such cutting apparatus could alternatively comprise a series of jet nozzles positioned along tube members that blow jetting fluid to form the pilot hole as shown in FIG. 7. Also, a single tube member could be used. Furthermore, such cutting apparatus could also comprise a narrow cutting blade as shown in FIG. 8 or plowshare as shown in FIG. 9 mounted vertically at the front of the pipe trenching plow 40. Although the cutting apparatus as it cuts a pilot hole will cause some turbidity, such turbidity is significantly reduced from prior art systems.

The counter-rotating cutters are positioned to rotate on their vertical axis and are in meshed relation to each other. The counter-rotating cutters are fixed to journal braces 43 mounted to the leading edge of the pipe trenching plow. A motor (not shown) may be positioned above or behind the journal braces 43 to power the rotation of the counter-rotating cutters. The motor is supplied power from a generator located on a surface vessel or an underwater tractor machine and a power cable extends from the surface vessel or the underwater tractor machine to the motor.

Referring generally to FIGS. 1–10, the pipe trenching plow 40 further includes a pair of spreading side sections 44 extending rearwardly from the cutting apparatus 42 to form a plowing wedge. A pipe support roller 36 is rotatably mounted on a roller bar 38 at the upper leading edge of the spreading side sections 44 above the cutting apparatus 42 to engage the pipe.

The spreading side sections 44 are formed of a plurality of side plates 46. The outer surfaces of the side plates 46 each engaging the seabed during expansion of the spreading side sections 44. The first pair of side plates 46 extend at an angle from the cutting apparatus 42 and are each hinged at the cutting apparatus 42. Each subsequent pair of side plates 46 is coupled to the preceding pair of side plates 46, and are hinged along their coupled edges. In one embodiment, each spreading side section 44 is comprised of three side plates 46. A second pipe support roller 36 is rotatably mounted between the spreading side sections 44 by a roller bar 38 intermediate the third pair of side plates 46. This pipe support roller 36 providing additional bracing to the spreading side sections 44 and additional cradling to the pipe as it continues to descend into the trench.

Figure 4:
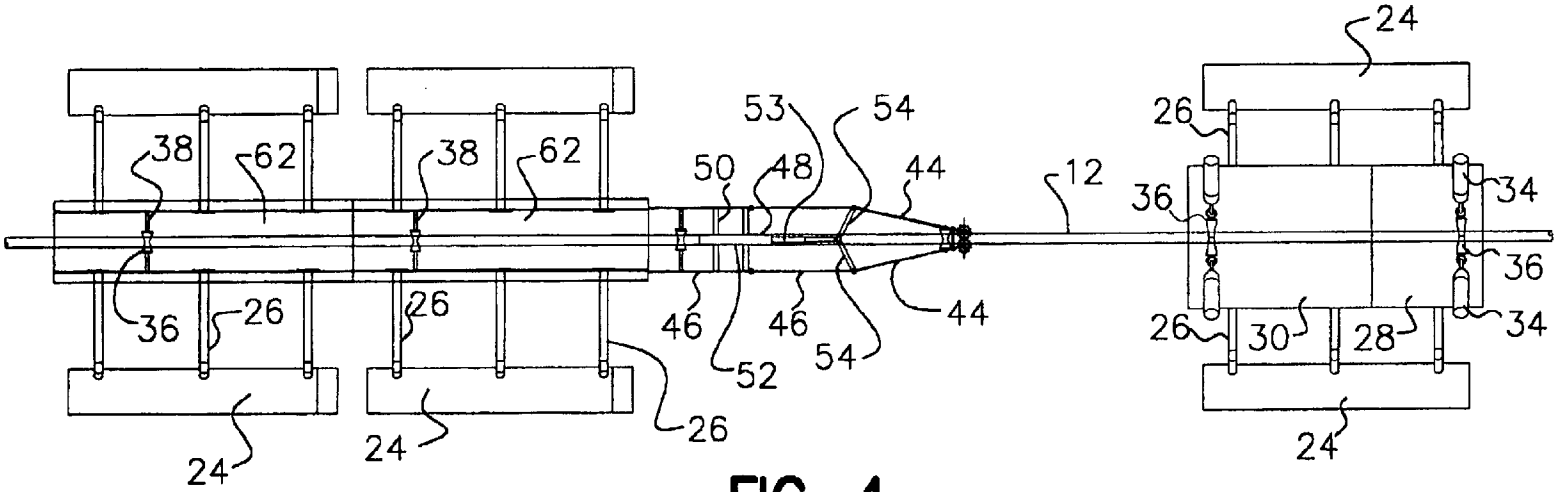
FIG. 4 is a top view of the pipe laying system of the present invention.
Figure 5:
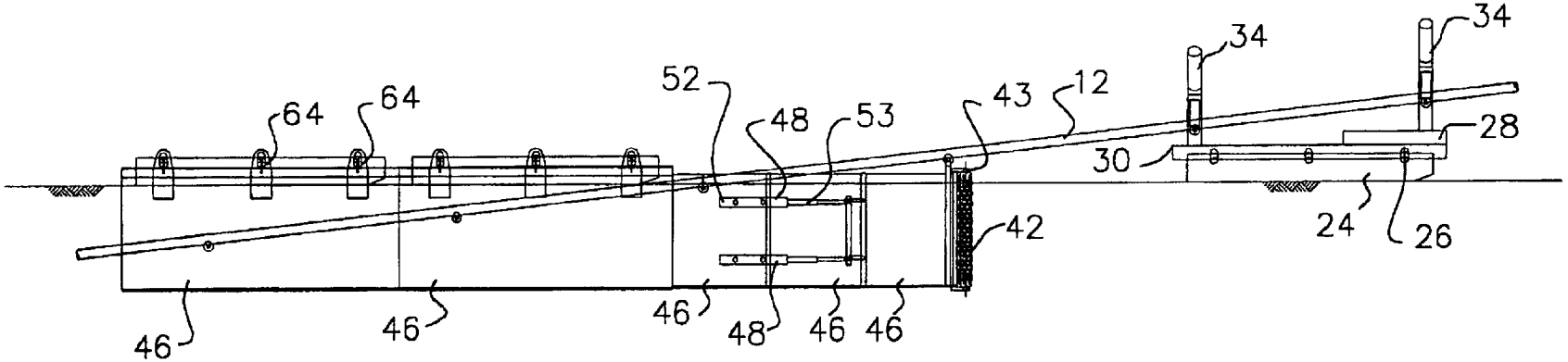
FIG. 5 is a side view of the pipe laying system of the present invention as advanced along a seabed.

As best shown in FIGS. 4 and 5, intermediate the spreading side sections 44 approximately along the horizontal axis of the pipe trenching plow 40 is positioned a pair of hydraulically operated piston rod assemblies 48. The piston rod assemblies mounted to the interior surfaces of the spreading side sections 44 in vertical spaced relation to each other by a plurality of transverse mounting braces 50. Each piston rod assembly includes a piston 52 and a piston rod 53. The piston rods 53 are pivotally mounted to a pair of spreading members 54 at the forward end of the piston rods 53. Each spreading member 54 is further hinged to the first and second side plates 46 of the spreading side sections 44.

Figure 11:
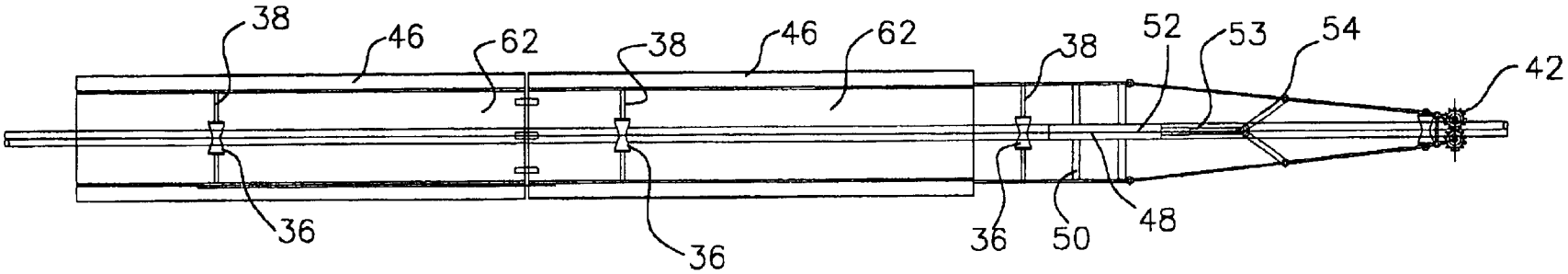
FIG. 11 is an enlarged top view of the pipe trenching plow of the present invention showing the spreading side sections of the present invention in the contracted position.
Figure 12:
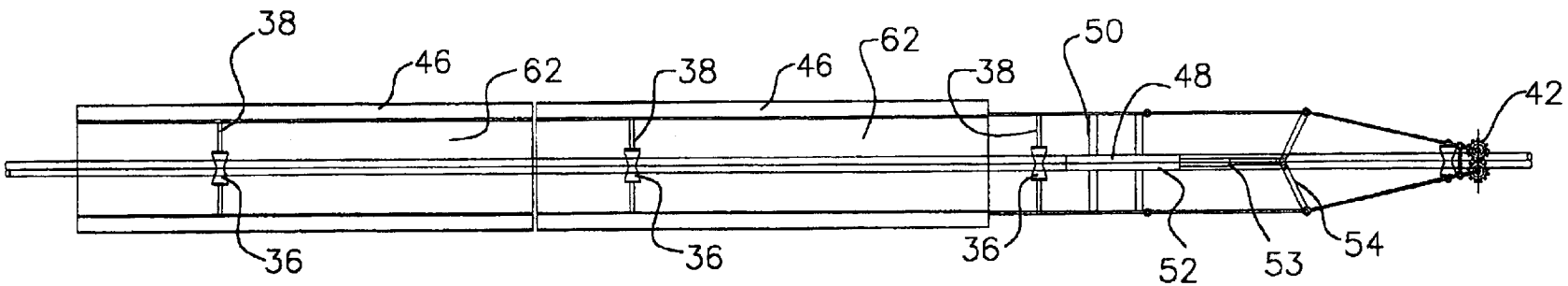
FIG. 12 is an enlarged top view of the pipe trenching plow of the present invention showing the spreading side sections of the present invention in the expanded position.

As best shown in FIGS. 11 and 12, the piston rod assemblies 48 alternate between a contracted position and an expanded position to continuously sweep the spreading side sections 44 in an outward direction. The sweeping motion of the spreading side sections 44 creating a shoveling and packing effect on the seabed to widen and form a rectangular trench. Referring to FIG. 11, the piston rod 53 is in the contracted position drawing back the spreading members 54. The spreading members 54 continue to be drawn back until the first and second side plates 46 of the spreading side section 44 are aligned to form a flat plow face. As shown in FIG. 12, when the piston rod 53 is in the extended position, the spreading members force the spreading side section 44 outward. The second side plate 46 swings into alignment with the third side plate 46 and engages the trench wall to further pack the wall. As the piston rod 53 extends, the first side plate 46 forms a more acute angle of engagement with the seabed causing a shoveling effect. As this cycle is continued, the motion of the piston rod 53 from the contracted position to the extended position causes the plowing of the seabed by the spreading side sections 44 in a continuous shoveling motion. Although this repetitive motion causes some turbidity in the seabed, the level of turbidity is significantly reduced over the levels of turbidity caused by similar prior art trenching systems.

It is also a feature of the invention that as the piston rod 53 is contracted and the first side plate 46 is drawn to a more acute angle, the cutting apparatus 43 is backed momentarily away from the seabed at the pilot hole. As the piston rod 43 then returns to the extended position in association with the forward advancement of the pipe trenching plow 40, the cutting apparatus is thrust forward to further form the pilot hole. As the piston rod 43 continues to cycle through the contracted and extended positions, the cutting apparatus is continuously thrust into the pilot hole to advance the pilot hole forward.

Although a hydraulically driven piston rod is used to expand and contract the spreading side sections 44, it can be appreciated that the use of other expansion mechanics could be used, including, without limitation, electrical or mechanical mechanisms. If necessary, power could be supplied to mechanisms from a surface vessel or an underwater tractor machine.

As generally shown in FIGS. 1–12, the pipe trenching plow 40 further includes a plurality of trench box sections 60 that follow the spreading side sections 44. The number of trench box sections 60 cascaded behind the spreading side sections 44 will depend on the angle of descent of the pipe which is further a function of the bending characteristics of the pipe. The bending characteristics of the pipe are a function of the diameter of the pipe and the material of the pipe. It can be appreciated that a sufficient number of trench box sections 60 will be coupled to the spreading side sections 44 to allow the pipe to come to rest on the bottom of the trench. It can also be appreciated that a single extended trench box section could be used instead of a plurality of trench box sections cascaded in sequence, and such single extended trench box section would function in accordance with this invention.

Each trench box section 60 includes two side plates 46 and a bottom plate 62. Each trench box section 60 further includes a pair of laterally spaced pontoons 24 rigidly connected to the side plates 46 by cross members 26. The upper edges of the side plates 46 are flared outwardly to form a flange. The pontoons 24 engage the floor of the seabed and provide stability and bracing to the trench box section 60. The cross members 26 are mounted along the upper edge of the side plates 46 using a plurality of cross member mounts 64. The bottom plate 62 of the trench box section 60 engages the trench bottom and packs the trench bottom as the pipe trenching plow 40 is towed along the trench bottom.

Intermediate the side plates 46 is positioned a pipe support roller 36 rotatably mounted to a roller bar 38 joined to the interior surfaces of the side plates 46. The pipe support roller 36 is positioned at different elevations in each trench box section 60 as best shown in FIG. 5. Each pipe support roller 36 is positioned at an elevation in order to cradle the pipe as it descends downwardly toward the trench bottom at its descent angle. As discussed, the degree of slope of the pipe and thus the position of the pipe support rollers 36 is a function of the diameter and material characteristics of the pipe.

During operation, the trench box sections 60 are dragged through the trench formed by the pipe trenching plow 40. The side plates 46 of the trench box section 60 pack and retain the sidewalls of the trench as the side plates 46 pass the sidewalls. The bottom plate 62 also packs the floor of the trench as the bottom plate 62 is dragged over the bottom. The side plates 46 and the bottom plate 62 of the trench box section 60 retain the geometry of the trench allowing the pipe to slowly descend and slope into the trench. If the trench box sections 60 did not retain the sidewalls of the seabed, the sidewalls would slough into the trench.

Following the last trench box section 60 is coupled a trench covering section 70. The trench covering section 70 includes a base plate 72 and a chute apparatus 74 joined above and passing through the base plate 72. The trench covering section 70 further includes a pair of laterally spaced pontoons 24 rigidly connected to the base plate 72 by cross members 26. The upper edges of the chute apparatus 74 are flared outwardly to form a flange.

In operation, the pontoons 24 engage the floor of the seabed and provide stability and bracing to the trench covering section 70. As the pipe trenching plow 40 advances, the trench covering section 70 is dragged above and over the pipe trench path. At this point, the pipe rests in the trench after its slow descent to the trench bottom through the trench box sections 60. The user of the system can then pour covering material into the chute apparatus 74 and the covering material will be spread over the pipe to fill the trench. The covering material can be delivered mechanically from an underwater delivery machine or can be piped into the chute apparatus from a surface vessel. Various covering materials are suitable for use with the trench covering section 70, but typically will include shells or sand.

As already described, the operation of the pipe laying system 10 of the present invention will now be summarized with particular reference to FIGS. 5, 11 and 12. As discussed, typically the pipe laying system 10 will be towed by a surface vessel but in some deep water applications an underwater tractor may also be used. In either application, a surface vessel is typically involved to carry the electrical generators, hydraulic pumps, control equipment, pump reels and other equipment for supplying and operating the apparatus. To lay the pipeline, the pipeline must first be cradled over the pipe guide assemblies 32 on the pipe guiding sled 20. As the pipe guiding sled 20 and the pipe trenching plow 40 are advanced forward, the weight of the spreading side sections 44 and the trench box sections 60 will cause the pipe trenching plow 40 to bury itself into the seabed as it is advanced along the seabed. As the cutting apparatus 42 cuts the pilot hole and the spreading side sections 44 widen the trench, the pipe trenching plow 40 will continue to dig to lower elevations until the pontoons 24 of the trench box sections 60 engage the seabed surface. As the pontoons 24 are dragged along the seabed surface, the pontoons 24 will cause the trench to be dug and maintained at a consistent depth.

The trench digging and formation process is also best shown in FIGS. 5, 11 and 12. Initially, the cutting apparatus 42 will create a pilot hole in the seabed. As the pipe trenching plow 40 is advanced, the front of the spreading side sections 44 will engage and enter the pilot hole. As the outer surfaces of the side plates 46 of the spreading side sections 44 engage the seabed, the side plates 46 will plow seabed forming the sidewalls of a trench. This plowing motion is enhanced by the action of the spreading side sections 44 in accordance with the invention. The piston rod assemblies 48 will continuously alternate between a contracted position and an expanded position causing the spreading side sections to continuously contract and expand. During the expansion cycle, the spreading side sections 44 shovel the seabed back and pack the seabed sediment of the trench sidewalls. During a contracting cycle, the spreading side sections 44 are drawn back and advanced forward by the movement of the pipe trenching plow 40. Also, the cutting apparatus 42 develops a contraction and expansion motion as the cutting apparatus 42 is continuously drawn and then urged forward by the motion. The cutting apparatus 42 being urged forward as the spreading side sections 44 are contracted and being drawn back as the spreading side sections 44 are expanded. In this manner, the pipe trenching plow 40 of the present invention forms a trench and buries pipe in the trench with a minimal amount of turbidity and disturbance to the seabed.

Although a preferred embodiment of the present invention has been described with reference to the foregoing detailed description and the accompanying drawings, it will be understood that the present invention is not limited to the preferred embodiment disclosed but includes modifications and equivalents without departing from the scope of the invention as claimed.

We claim:

1. An underwater pipe laying system for burying pipe in a seabed comprising:

a pipe guiding sled for supporting and guiding a pipe;

a pipe trenching plow following the pipe guiding sled, the pipe trenching plow having a pilot hole cutting apparatus, the pipe trenching plow further having a pair of spreading side sections forming a wedge that are expanded and contracted, the spreading side sections widening upon expansion to form a trench as the pipe trenching plow is advanced, the pipe trenching plow having support rollers for directing the pipe downward intermediate the spreading side sections; and a trench box section following the pipe trenching plow for retaining the trench geometry, the trench box section having support rollers for supporting and guiding the pipe into the trench.

2. The underwater pipe laying system of claim 1 further comprising a hydraulically operated piston rod assembly having a piston and a piston rod for driving spreading members, the piston rod assembly alternating between a contracted position and an expanded position, the spreading members drawn when the piston rod assembly is in a contracted position and the spreading members extended when the piston rod assembly is in an extended position.

3. The underwater pipe laying system of claim 1 further comprising a trench covering section, the trench covering section including a chute apparatus.

4. The underwater pipe laying system of claim 1 wherein the pipe guiding sled includes a base and a plurality of laterally spaced pontoons extending from the base, the base having a plurality of pipe guide assemblies mounted to the base supporting the pipe, each successive pipe guide assembly having a pipe support roller positioned at an elevation to engage the pipe.

5. The underwater pipe laying system of claim 1 wherein the pilot hole cutting apparatus is a pair of vertically mounted counter-rotating cutters.

6. The underwater pipe laying system of claim 1 wherein the pilot hole cutting apparatus is a plurality of jetting nozzles positioned along a vertically mounted tube member, the jetting nozzles blowing fluid to form the pilot hole.

7. The underwater pipe laying system of claim 1 wherein the pilot hole cutting apparatus is a cutting blade.

8. The underwater pipe laying system of claim 1 wherein the pilot hole cutting apparatus is a plowshare.

9. The underwater pipe laying system of claim 1 further comprising a plurality of trench box sections.

10. The underwater pipe laying system of claim 1 wherein the trench box section includes two side plates, a bottom plate, and a plurality of laterally spaced pontoons mounted to the side plates, the pontoons engaging the floor of the seabed.

11. The underwater pipe laying system of claim 1 wherein the trench box section includes at least one pipe support roller, the pipe support roller positioned at an elevation to engage the pipe.

12. The underwater pipe laying system of claim 1, wherein the pair of spreading side sections substantially widen the trench.

13. A method for laying and burying pipe in a seabed comprising:

forming a pilot hole in a seabed for advancement of a pipe using a cutting apparatus, widening the pilot hole to form a trench using a plurality of expandable spreading side sections, the spreading side sections alternatingly driven from a contracted position to an expanded position by a drive means, the cycle of the drive means urging the spreading side sections outward in a continuous shoveling motion, and supporting the trench geometry using a trench box section and advancing the pipe into the trench.

14. The method of claim 13 further comprising supporting the weight of the pipe and guiding the pipe at a consistent angle of descent toward the trench.

15. The method of claim 13 further comprising providing for a consistent trench depth by using laterally spaced pontoons mounted to a pipe trenching plow.

16. The method of claim 13 further comprising advancing the cutting apparatus as the spreading side sections are contracted and contracting the cutting apparatus as the spreading side sections are expanded to further the formation of the pilot hole.

17. The method of claim 13 further comprising covering the pipe laid in the trench with covering material.

18. The method of claim 13 wherein the cutting apparatus is a pair of vertically mounted counter-rotating cutters.

19. The method of claim 13 wherein the cutting apparatus is a plurality of jetting nozzles positioned along a vertically mounted tube member, the jetting nozzles blowing fluid to form the pilot hole.

20. The method of claim 13 wherein the cutting apparatus is a cutting blade.

21. The method of claim 13 wherein the cutting apparatus is a plowshare.

22. The method of claim 13, wherein the plurality of expandable spreading side sections substantially widen the trench.

23. A pipe trenching plow for forming a pipe trench in a seabed comprising:

means for cutting mounted at the forward edge of the pipe trenching plow for forming a pilot hole in the seabed, means for spreading expanded by a drive means to widen the pilot hole to form a trench, and means for retaining the trench geometry formed by the means for spreading, wherein the means for spreading substantially widens the trench.

* * * * *